US010536778B2

(12) United States Patent
Sekiguchi et al.

(10) Patent No.: US 10,536,778 B2
(45) Date of Patent: Jan. 14, 2020

(54) INFORMATION PROCESSING APPARATUS, INFORMATION PROCESSING METHOD AND AUDIO SYSTEM

(71) Applicant: Yamaha Corporation, Hamamatsu-shi, Shizuoka-Ken (JP)

(72) Inventors: Kohei Sekiguchi, Hamamatsu (JP); Yuta Yuyama, Hamamatsu (JP); Kunihiro Kumagai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/270,786

(22) Filed: Feb. 8, 2019

(65) Prior Publication Data

US 2019/0253798 A1 Aug. 15, 2019

(30) Foreign Application Priority Data

Feb. 9, 2018 (JP) ..... 2018-021619

(51) Int. Cl.
*H04R 3/12* (2006.01)
*H04R 29/00* (2006.01)

(52) U.S. Cl.
CPC ..... *H04R 3/12* (2013.01); *H04R 29/001* (2013.01); *H04R 2430/01* (2013.01)

(58) Field of Classification Search
None
See application file for complete search history.

(56) References Cited

U.S. PATENT DOCUMENTS

2013/0156198 A1* 6/2013 Kim ..... H04R 1/323 381/17
2014/0079230 A1* 3/2014 Mizuta ..... H04R 29/001 381/59
2017/0325028 A1* 11/2017 Lee ..... H04R 5/02
2019/0070517 A1* 3/2019 Zuniga ..... A63H 3/28
2019/0079230 A1* 3/2019 Nguyen ..... C03C 17/42

FOREIGN PATENT DOCUMENTS

JP 2003-283599 A 10/2003

* cited by examiner

*Primary Examiner* — Paul W Huber
(74) *Attorney, Agent, or Firm* — Crowell & Moring LLP

(57) ABSTRACT

An information processing apparatus includes a processor that performs a separate process to separate a content signal into a primary component which is an objective sound and a secondary component which is other than the objective sound, a speaker that outputs the primary component, and a transmitter that transmits the secondary component to another apparatus.

15 Claims, 7 Drawing Sheets

INFORMATION PROCESSING APPARATUS, INFORMATION PROCESSING METHOD AND AUDIO SYSTEM

CROSS REFERENCE TO RELATED APPLICATIONS

This Nonprovisional application claims priority under 35 U.S.C. § 119(a) on Patent Application No. 2018-021619 filed in Japan on Feb. 9, 2018 the entire contents of which are hereby incorporated by reference.

BACKGROUND

1. Field of the Invention

The present invention, in some aspects thereof, relates to an information processing apparatus, an information processing method and an audio system for processing a content signal.

2. Description of the Related Art

Patent Literature 1 (JP 2003-283599 A) discloses a wireless mobile phone terminal that causes a built-in speaker thereof and a speaker connected to the wireless mobile phone terminal through an earphone jack thereof to emit sounds, and a speaker control method used therefor. The speaker control method described in Patent Literature 1 performs control such that built-in speakers Lch and Rch output main music while external speakers Lch and Rch output a sound echo, a residual sound and the like in order to produce a realistic effect.

SUMMARY

1. Technical Problem

Because the speaker control method described in Patent Literature 1 employs a simple setting by which the main music and the sound echo, the residual sound, and the like are merely separated between the internal speakers and the external speakers, the sound source outputted from each speakers is the same. For this reason, in the above-mentioned prior art, no other sound sources are outputted from other places, so it seems unlikely to reproduce the sound in three-dimensional.

Accordingly, the present invention, in some aspects thereof, is directed to providing an information processing apparatus, an information processing method and an audio system that are capable of producing an unprecedented three-dimensional effect.

2. Solution to Problem

An information processing apparatus includes a processor that performs a process to separate a content signal into a primary component which is an objective sound and a secondary component which is other than the objective sound, a speaker that outputs the primary component, and a transmitter that transmits the secondary component to another apparatus.

DESCRIPTION OF THE PREFERRED EMBODIMENTS

Figure 1:
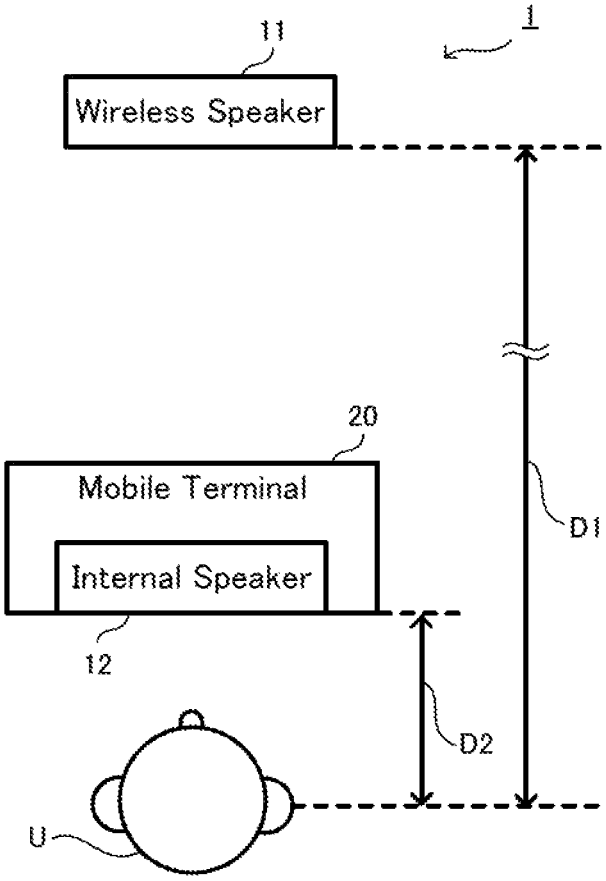
FIG. 1 is an illustration to explain usage of an audio system employing a mobile terminal according to a first embodiment of the present invention.
Figure 2:
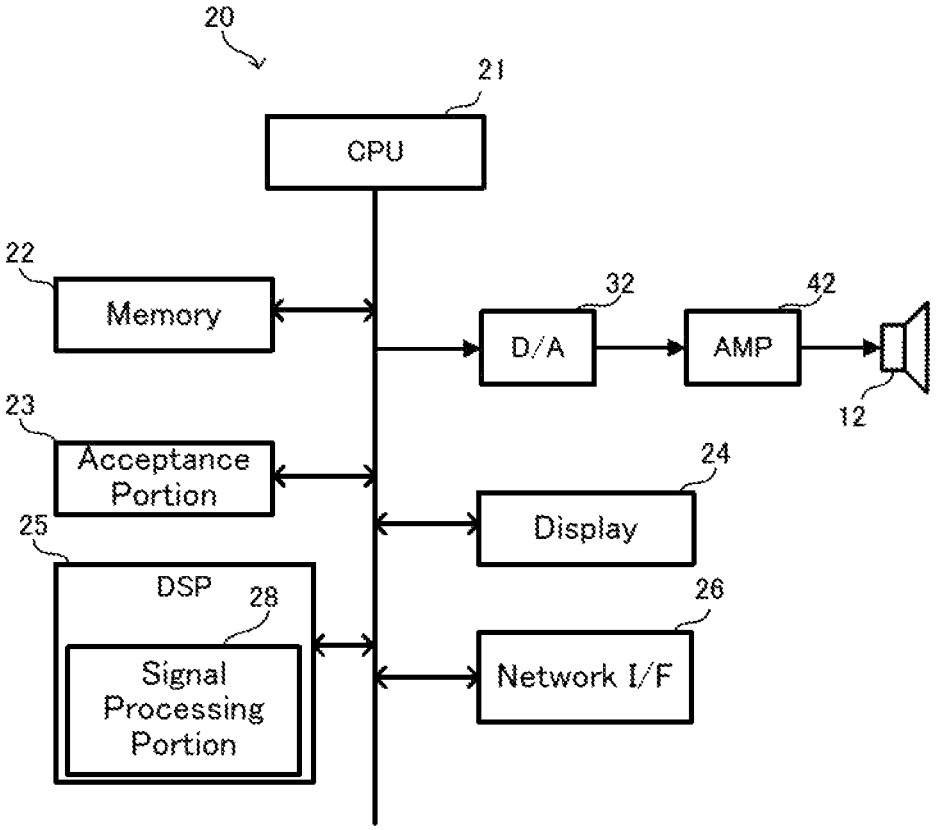
FIG. 2 is a block diagram showing a configuration of the mobile terminal according to the first embodiment.

FIG. 1 is an illustration to explain usage of an audio system employing a mobile terminal according to a first embodiment of the present invention. FIG. 2 is a block diagram showing a configuration of the mobile terminal according to the first embodiment.

As shown in FIG. 1, an audio system 1 includes a mobile terminal 20 and a wireless speaker 11. The mobile terminal 20 includes an internal speaker 12. Here, the mobile terminal 20 is an example of an "information processing apparatus" or a "first apparatus" of the present invention. Also, the wireless speaker 11 is an example of "another apparatus" or a "second apparatus" of the present invention. The mobile terminal 20 is one usually carried by a user. Therefore, in the first embodiment, explanation is made assuming a situation in which the mobile terminal 20 is located much closer to the user U compared to the wireless speaker 11.

The mobile terminal 20 is, for example, a smart phone, a tablet, a PC or the like. The mobile terminal 20 is used to operate each device on a network. The mobile terminal 20 and the wireless speaker 11 transmit and receive audio data by respectively outputting and inputting a wireless signal according to Wi-Fi (Registered Trademark) specifications, Bluetooth (Registered Trademark) specifications or the like. The mobile terminal 20 transmits the audio data to an internal speaker 12 that is built in the mobile terminal 20. Then, the wireless speaker 11 and the internal speaker 12 each reproduce audio data they respectively receive. Further, instead of the wireless speaker 11, it is also possible to use a wired speaker with wired connection.

As shown in FIG. 2, the mobile terminal 20 includes a CPU 21, a memory 22, an acceptor 23, a display 24, a DSP (Digital Signal Processor) 26, and a network I/F 26. The network I/F 26 is an example of a "transmitter" of the present invention, and the DSP 25 is an example of a "processor" of the present invention.

The network I/F 26 inputs and outputs wireless signals according to Wi-Fi (Registered Trademark) specifications, Bluetooth (Registered Trademark) specifications or the like. The network I/F 26 enables the mobile terminal 20 to perform communications with the wireless speaker 11.

The acceptor 23 accepts an operation by the user U. The acceptor 23 may include either an operation button or a touch panel. The display 24 is a display that is built in the mobile terminal 20. Additionally, in this embodiment, the display 24 is laminated with a touch panel. The memory 22 includes a RAM and a ROM. The memory 22 stores programs that the CPU 21 executes, results of arithmetic processing, information the network I/F 26 receives and so forth. Also, the memory 22 stores content data. However, content data are not limited to the ones stored in the memory 22, but may include those acquired from a server through the network I/F 26.

In the first embodiment, explanation is made as to a case in which movie content is dealt with as content data. The movie content includes dialog, sound effect, BGM, environmental sound or the like. However, the movie content is only an example of the content data, and the content data is not limited to the movie content.

The CPU 21 reads out a program from the memory 22, and executes the read-out program. The DSP 25 includes a signal processor 28. Detailed description of a process performed by the signal processor 28 is given later.

Further, the mobile terminal 20 includes a D/A converter 32, an amplifier (AMP) 42 and the internal speaker 12. The CPU 21 inputs a digital signal that is supplied from the DSP 25 to the D/A converter 32. The D/A converter 32 converts the supplied digital signal into an analog signal, and inputs the converted analog signal to the AMP 42. The AMP 42 amplifies the supplied analog signal, and outputs the amplified analog signal to the internal speaker 12. The internal speaker 12 emits a sound depending on the analog signal that is supplied from the AMP 42.

Subsequently, explanation is made as to a case where the mobile terminal 20 has acquired movie content through the network I/F 26. The movie content the network I/F 26 has acquired is inputted to the DSP 25. The DSP 25 decodes the inputted movie content, and extracts an audio signal. The DSP 25 separates the audio signal into a primary component and a secondary component. The audio signal is an example of a "content signal" of the present invention.

Here, the primary component is an objective sound in the audio signal. For instance, in a case where the audio signal is movie content, the primary component includes dialog, lyrics or the like as sound component, or sound effect, etc. On the other hand, the secondary component is a component which is other than the objective sound in the audio signal. For instance, in the case where the audio signal is the movie content, the secondary component includes BGM or the like that is other than dialog, lyrics, sound effect or the like.

The separation of the audio signal into the primary component and the secondary component is achieved using a known procedure, for example, such as Independent Component Analysis (ICA), Nonnegative Matrix Factorization (NMF) or the like. Besides, the separation of the audio signal may be carried out in other ways as long as they separate the audio signal into the primary component and the secondary component, and thus, may be carried out, for example, using a combination of procedures ICA and NMF, etc. Moreover, the separation can also be achieved through an analysis of feature quantities of a frequency domain in machine learning according to a Gaussian Mixture Model (GMM) that uses a mixed Gaussian distribution which is a linear combination of some Gaussian distributions. With these procedures, it is made possible for the DSP 25 to separate the audio signal into dialog, sound effect or the like that forms the primary component and BGM or the like that forms the secondary component.

The separated primary component is output to the speaker 12 in the mobile terminal 20, and is emitted therefrom. On the other hand, the separated secondary component is transmitted to the wireless speaker 11, and is emitted therefrom. Thus, sound of dialog, lyrics, sound effect or the like is reproduced at a position that is close to the user U, and sound of BGM or the like is reproduced at a position that is away from the user U. This enables the audio system 1 to allow the user U to hear the sound of dialog, lyrics, sound effect or the like closely, and to hear the sound of BGM or the like from far. In this manner, by realizing an unprecedented procedure for content sound reproduction, it is made possible for the audio system according to the present embodiment to reproduce a three-dimensional sound with more depth.

Figure 3:
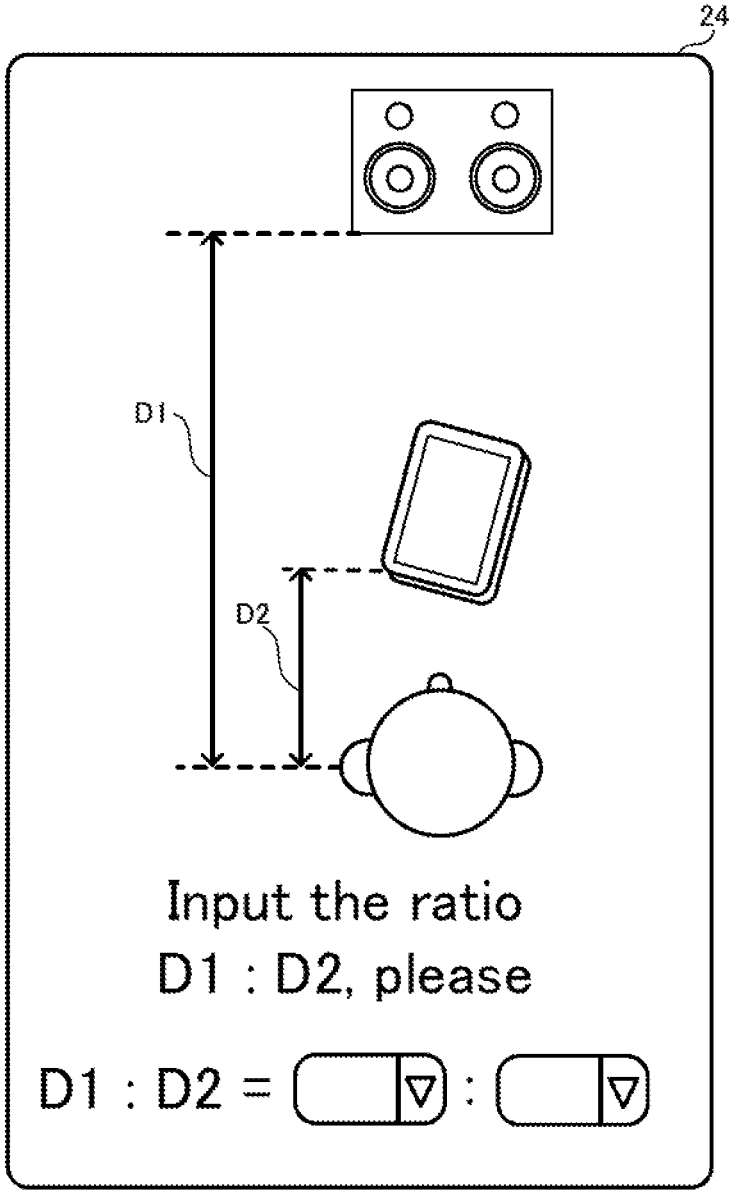
FIG. 3 is a diagram showing an example of a screen through which a user performs input to an acceptor.

Subsequently, explanation is made as to a case where the signal processor 28 makes a correction to the audio data depending on distances from the user U to the mobile terminal 20 and from the user U to the wireless speaker 11. FIG. 3 is a diagram showing an example of a screen through which a user performs input to an acceptor. Here, as shown in FIG. 1, explanation is made defining that a distance from a listening position of the user U to the wireless speaker 11 is D1 and that a distance from the user U to the mobile terminal 20 is D2.

As shown in FIG. 3, the CPU 21 causes the display 24 of the mobile terminal 20 to display a screen with which the user U inputs the distance D1 and the distance D2. The acceptor 23 accepts input of the distance D1 and the distance D2 that is performed by the user U. In this example, the acceptor 23 accepts input of a ratio between the distance D2 and the distance D1 (D2:D1). Here, the ratio between the distances is not limited to the one calculated from actual measurements of the distances, but may be a ratio between distances from the user U that are visually observed. This enables the user U to easily input an approximate ratio based on visual observation.

The DSP 25, depending on the ratio between the distance D1 and the distance D2 (D2:D1), makes a correction to the audio signal that is separated into the primary component and the secondary component. The correction to the audio signal includes, for example, a volume adjustment and a timing adjustment.

The volume adjustment is an adjustment of volumes of sound emitted from the wireless speaker 11 and sound emitted from the internal speaker 12 of the mobile terminal 20. The DSP 25 increases a volume level of one side that is farther from the user U depending on the ratio between the distances from the user U. The timing adjustment is for correcting a time lag between the sounds arriving at the user U that arises from the ratio between the distances (D2:D1). Without a time lag between the sounds arriving at the user U, strangeness felt by the user U that is caused by the time lag can be reduced. Additionally, the input of the distances is not limited to the ratio between the distances, but may be actual distances. Also, by setting an estimated distance beforehand as the distance D2 from the user U to the mobile terminal 20, the input left for the user U to perform becomes just to input the distance D1 from the user U to the wireless speaker 11, which helps improve convenience of the user U.

Figure 4:
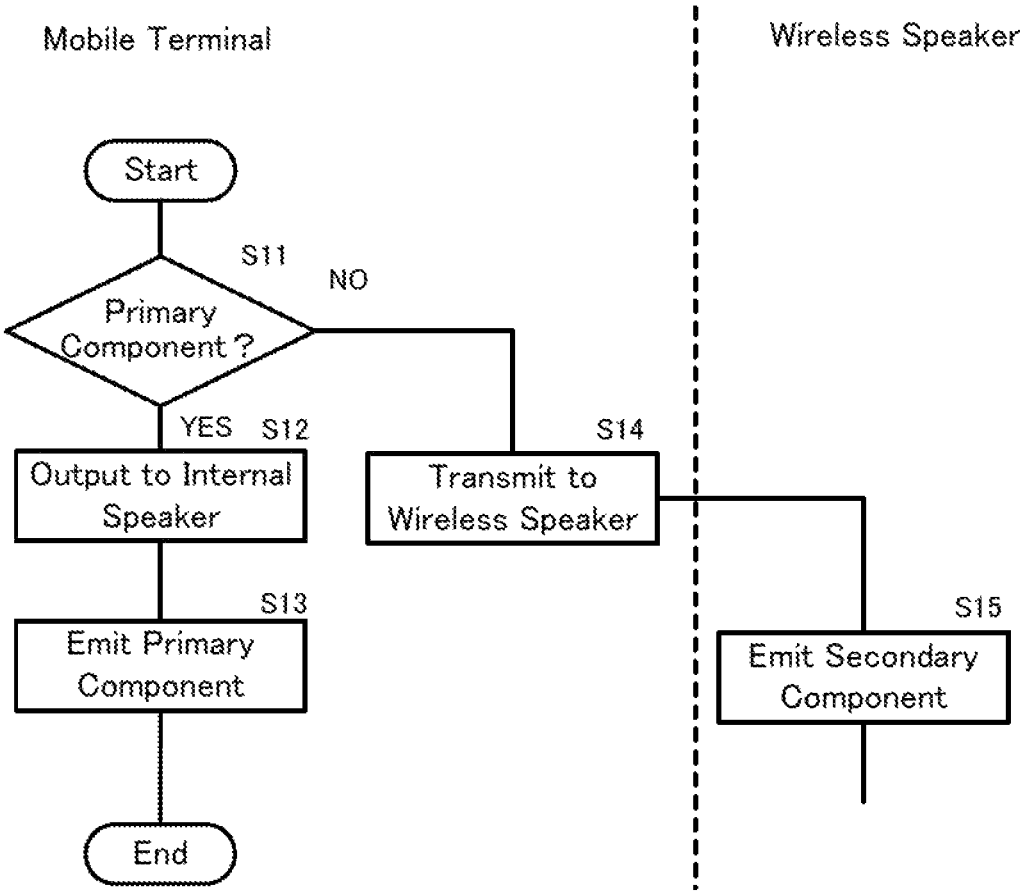
FIG. 4 is a flow chart showing an operation of the audio system 1 according to the first embodiment.

FIG. 4 is a flow chart showing an operation of the audio system 1 according to the first embodiment. Through the operation of the audio system 1, an information processing method of the present invention is realized.

As shown in FIG. 4, in the audio system 1, the DSP 25 of the mobile terminal 20 separates audio data selected by the user U into a primary component which is an objective sound and a secondary component which is other than the objective sound. That is, the DSP 25 separates the audio data based on whether or not each component contained in the audio data is a primary component (s11).

If the component separated by the DSP 25 is a primary component (s11:YES), the CPU 21 outputs the primary component to the internal speaker 12 (s12). The internal speaker 12 of the mobile terminal 20 emits the primary component (s13). On the other hand, if the component separated by the DSP 25 is not a primary component but a secondary component (s11:NO), the CPU 21 transmits the secondary component to the wireless speaker 11 (s14). The wireless speaker 11 emits the inputted secondary component (s15). Hereby, sound of dialog, lyrics, sound effect or the like is reproduced by the internal speaker 12 that is close to the user U, and sound of BGM or the like is reproduced by the wireless speaker 11 that is away from the user U. Therefore, by realizing an unprecedented procedure for content sound reproduction, it is made possible for the information processing method according to this embodiment to reproduce a three-dimensional sound with more depth.

Figure 5:
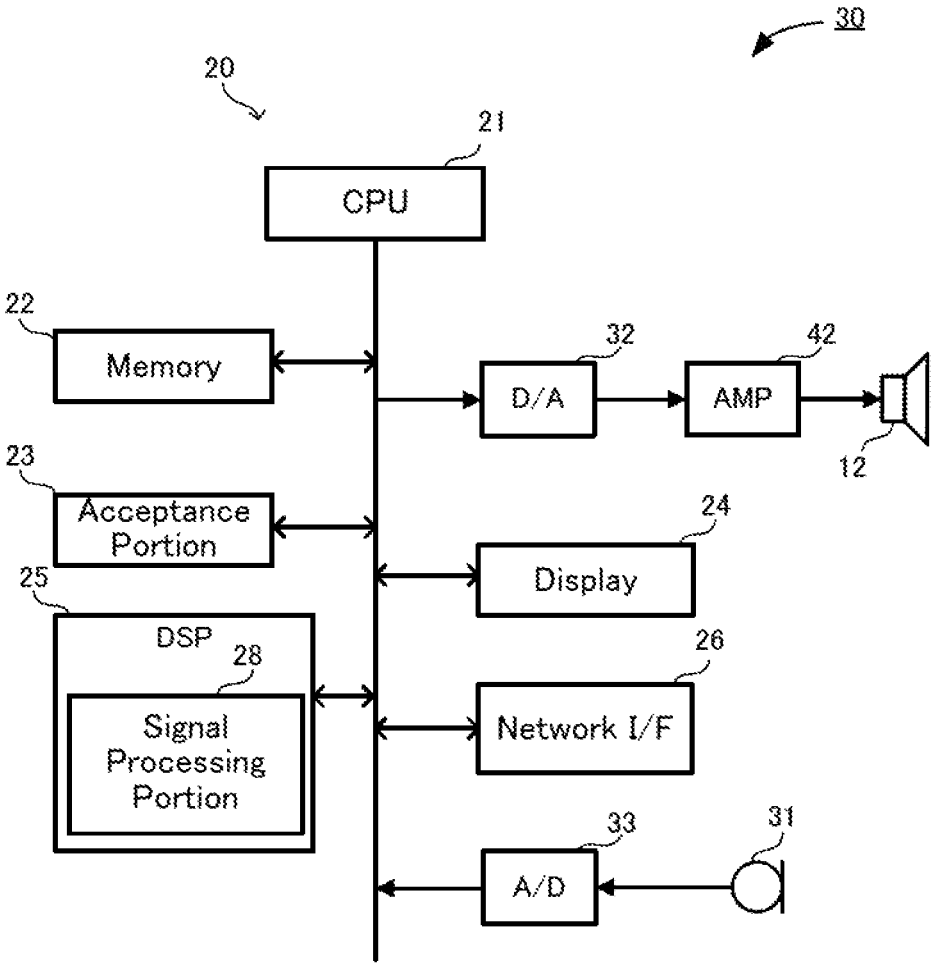
FIG. 5 is a block diagram showing a configuration of a mobile terminal according to a second embodiment of the present invention.

Next, a mobile terminal according to a second embodiment is explained below. FIG. 5 is a block diagram showing a configuration of a mobile terminal according to a second embodiment of the present invention. As shown in FIG. 5, the mobile terminal 30 according to the second embodiment includes a built-in microphone 31 and an A/D converter 33. The built-in microphone 31 collects sound, and inputs the collected sound as an analog signal to the A/D converter 33. The A/D converter 33 converts the supplied analog signal into a digital signal, and inputs the converted signal to the signal processor 28.

The network I/F 26 of the mobile terminal 20 transmits a test signal to the wireless speaker 11. The wireless speaker 11 outputs a test sound based on the received test signal.

The built-in microphone 31 of the mobile terminal 20 captures the test sound the wireless speaker 11 has output. The DSP 25 analyzes a time lag between the test sound the wireless speaker 11 has output and a test sound the internal speaker 12 has output. Based on the analyzed time lag between the test sounds, the DSP 25 estimates the distance D1 from the user U to the wireless speaker 11.

By using the estimated distance D1 for the correction to the audio data, the DSP 25 optimizes the correction to the audio data. For instance, when the estimated distance D1 is 150 cm and the distance D2 from the mobile terminal 20 to the user U has been set to be 15 cm beforehand, the ratio between the distances (D2:D1) becomes 1:10. The DSP 25 calculates the ratio between the distances based on the estimated distance D1, and uses this ratio for the correction to the audio data.

Figure 6:
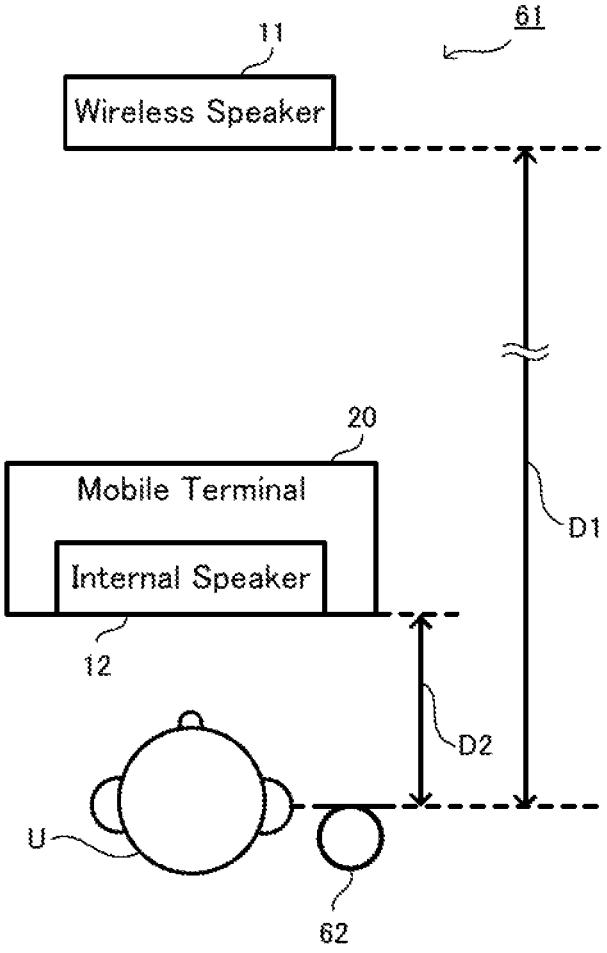
FIG. 6 is an illustration to explain usage of an audio system employing a mobile terminal according to a third embodiment of the present invention.

Next, an audio system according to a third embodiment is explained below. FIG. 6 is an illustration to explain usage of an audio system employing a mobile terminal according to a third embodiment of the present invention. As shown in FIG. 6, the audio system 61 according to the third embodiment further includes an external microphone 62, and other than that, it is the same as the audio system 1. In the explanation of the audio system 61 according to the third embodiment, explanation is omitted as to configurations similar to those of the audio system 1.

The audio system 61 includes an external microphone 62. The external microphone 62 is capable of wireless or wired communication with the mobile terminal 20. The audio system 61 corrects audio data using the external microphone 62.

The mobile terminal 20 outputs a test sound from the internal speaker 12. The network I/F 26 of the mobile terminal 20 transmits a test signal to the wireless speaker 11. The wireless speaker 11 outputs a test sound based on the received test signal. The external microphone 62 captures the test sound the wireless speaker 11 has output and the test sound the internal speaker 12 has output, respectively. The DSP 25 analyzes a time lag between the test sound the internal speaker 12 has output and the test sound the wireless speaker 11 has output that are captured by the external microphone 62.

The DSP 25 measures an analyzed distance from the wireless speaker 11 to the user U and a distance from the mobile terminal 20 to the user U. This enables the DSP 25 to obtain a ratio between the distance D2 and the distance D1 (D2:D1) more accurately. By using the obtained ratio for the correction to the audio data, the DSP 25 can optimize the correction to the audio data depending on actual usage condition. Moreover, the DSP 25 may perform the analysis and make the correction to the audio data based on the test sounds captured not only by the external microphone 62, but by both the built-in microphone 31 and the external microphone 62.

Figure 7:
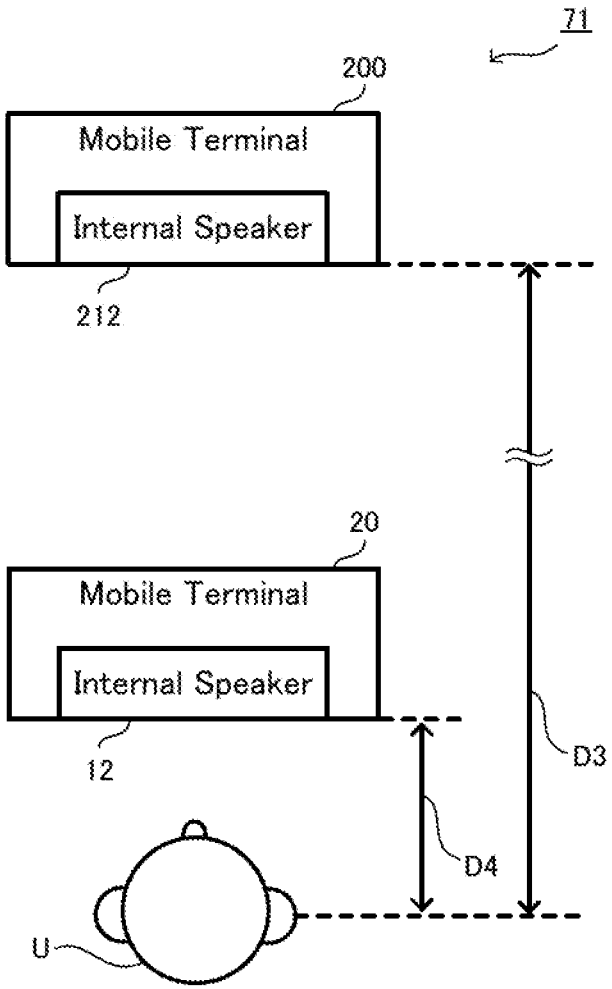
FIG. 7 is an illustration to explain usage of an audio system employing a mobile terminal according to an alternative embodiment of the present invention.

Subsequently, an audio system according to an alternative embodiment is explained below. FIG. 7 is an illustration to explain usage of an audio system employing a mobile terminal according to an alternative embodiment of the present invention. As shown in FIG. 7, the audio system 71 according to the alternative embodiment uses a mobile terminal 200 instead of the wireless speaker 11, and other than that, it is the same as the audio system 1. In the explanation of the audio system 71 according to the alternative embodiment, explanation is omitted as to configurations similar to those of the audio system 1.

The audio system 71 includes the mobile terminal 20 which is a first apparatus and the mobile terminal 200 which is a second apparatus. The mobile terminal 200 includes an internal speaker 212. In the alternative embodiment, the mobile terminal 20 is placed at a position closer to the listening position of the user U compared to the mobile terminal 200. Here, it is defined that a distance from the listening position of the user U to the mobile terminal 200 is D3 and that a distance from the user U to the mobile terminal 20 is D4. The user U can position the mobile terminal 20 close by and the mobile terminal 200 away, for example. By positioning the mobile terminal 20 and the mobile terminal 200 in this manner, it is possible to locate the internal speaker 12 of the mobile terminal 20 and the internal speaker 212 of the mobile terminal 200 respectively at different distances from the listening position of the user U. Thus, by realizing an unprecedented procedure for content sound reproduction, it is made possible for the audio system according to the alternative embodiment to reproduce a three-dimensional sound with more depth.

Additionally, in the embodiments and the alternative embodiment, the number of the wireless speaker 11 or the mobile terminal 200 is one, respectively; however, the number thereof is not limited to one, but may be plural. This allows the audio system according to the embodiments or the alternative embodiment to produce a more spreading sound field.

Moreover, in the embodiments and the alternative embodiment, the wireless speaker 11 or the mobile terminal 200 is positioned in front of the user, that is, ahead of the mobile terminal 20 when viewed from the user U; however, their positioning is not limited to front side, but may be on the rear side, or on lateral side in the right or left direction, of the user U. This allows the audio system according to the embodiments or the alternative embodiment to produce a more spreading sound field.

Further, the content signal is not limited to audio signal, but may include other signals. Other signals include, for example, light, vibration and/or the like. In the audio system 71 according to the alternative embodiment, the mobile terminal 200 produces a light with color that depends on content being reproduced. This makes it possible for the user to obtain a realistic feeling even visually in relation to the content being reproduced.

The above explanations of the embodiments are nothing more than illustrative in any respect, and are not restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An information processing apparatus comprising:

a processor that performs a separate process to separate a content signal into a primary component which is an objective sound and a secondary component which is other than the objective sound;

a speaker that outputs the primary component;

a transmitter that transmits the secondary component to another apparatus;

an acceptor that accepts input of a first distance from a user to the information processing apparatus and a second distance from the user to the other apparatus; and a signal processor that performs a correction process to make a correction to the content signal depending on the first distance and the second distance, wherein the correction includes a timing adjustment.

2. The information processing apparatus according to claim 1, wherein the objective sound includes at least an audio component.

3. The information processing apparatus according to claim 1, wherein the objective sound includes a sound effect.

4. The information processing apparatus according to claim 1, wherein the secondary component includes a BGM.

5. The information processing apparatus according to claim 1, wherein the correction includes a volume adjustment.

6. The information processing apparatus according to claim 1, wherein the signal processor performs the correction process depending on a ratio between the first distance and the second distance.

7. The information processing apparatus according to claim 6 further comprising a microphone, wherein the speaker outputs a test sound;

the transmitter transmits a test signal to the other apparatus;

the other apparatus outputs a test sound;

the microphone captures the test sound that is output from the speaker or from the other apparatus; and the signal processor measures the ratio between the first distance and the second distance.

8. A method for information processing adapted to an information processing apparatus, the method comprising:

separating a content signal into a primary component which is an objective sound and a secondary component which is other than the objective sound;

outputting the primary component from a speaker;

transmitting the secondary component to another apparatus;

accepting input of a first distance from a user to the information processing apparatus and a second distance from the user to the other apparatus; and making a correction to the content signal depending on the first distance and the second distance, wherein the correction includes a timing adjustment.

9. The method for information processing according to claim 8, wherein the objective sound includes at least an audio component.

10. The method for information processing according to claim 8, wherein the objective sound includes a sound effect.

11. The method for information processing according to claim 8, wherein the secondary component includes a BGM.

12. The method for information processing according to claim 8, wherein the correction includes a volume adjustment.

13. The method for information processing according to claim 8, wherein the correction to the content signal is made depending on a ratio between the first distance and the second distance.

14. The method for information processing according to claim 13, the method further comprising:

outputting a test sound from the speaker;

transmitting a test signal to the other apparatus;

outputting a test sound from the other apparatus;

capturing with a microphone the test sound that is output from the speaker or from the other apparatus; and measuring a ratio between the first distance and the second distance.

15. An audio system comprising:

a first apparatus and a second apparatus, the first apparatus separating a content signal into a primary component which is an objective sound and a secondary component which is other than the objective sound, outputting the primary component from a first speaker, and performing a process to transmit the secondary component to the second apparatus, wherein the first apparatus accepts input of a first distance from a user to the first apparatus and a second distance from the user to the second apparatus, and performs a correction process to make a correction to the content signal depending on the first distance and the second distance, wherein the correction signal includes a timing adjustment, the second apparatus receiving the secondary component from the first apparatus, and outputting the secondary component from a second speaker.

* * * * *